United States Patent [19]

Royer

[11] Patent Number: 4,721,525

[45] Date of Patent: Jan. 26, 1988

[54] EXTRACTION PROCESS FOR REMOVING METALLIC IMPURITIES FROM ALKALIDE METALS

[75] Inventor: Lamar T. Royer, Knoxville, Tenn.

[73] Assignee: The United States of America as represented by the United States Department of Energy, Washington, D.C.

[21] Appl. No.: 28,267

[22] Filed: Mar. 20, 1987

[51] Int. Cl.[4] ..... C22B 26/10; C22B 26/12

[52] U.S. Cl. ..... 75/63; 75/66

[58] Field of Search ..... 75/63, 66

[56] References Cited

U.S. PATENT DOCUMENTS

| | | | |
|---|---|---|---|
| 2,468,660 | 4/1949 | Gjedebo | 75/63 |
| 2,863,757 | 12/1958 | Altmier et al. | 75/66 |
| 2,866,702 | 12/1958 | Batutis et al. | 75/66 |
| 2,879,157 | 3/1959 | Batutis et al. | 75/66 |
| 3,484,233 | 12/1969 | Bonilla | 75/63 |
| 3,854,933 | 12/1974 | Furukawa et al. | 75/66 |
| 4,456,479 | 6/1984 | Harris et al. | 75/63 |
| 4,511,389 | 4/1985 | Kugler | 75/63 |

*Primary Examiner*—L. Dewayne Rutledge
*Assistant Examiner*—David W. Schumaker
*Attorney, Agent, or Firm*—Earl L. Larcher; Stephen D. Hamel; Judson R. Hightower

[57] ABSTRACT

A development is described for removing metallic impurities from alkali metals by employing an extraction process wherein the metallic impurities are extracted from a molten alkali metal into molten lithium metal due to the immiscibility of the alkali metals in lithium and the miscibility of the metallic contaminants or impurities in the lithium. The purified alkali metal may be readily separated from the contaminant-containing lithium metal by simple decanting due to the differences in densities and melting temperatures of the alkali metals as compared to lithium.

4 Claims, No Drawings

EXTRACTION PROCESS FOR REMOVING METALLIC IMPURITIES FROM ALKALIDE METALS

This invention was made as a result of work under a contract DE-AC05-84OR21400 between Martin Marietta Energy Systems, Inc., and the U.S. Department of Energy.

BACKGROUND OF INVENTION

The present invention relates generally to a process for removing metallic impurities from alkali metals, and more particularly to an extraction process utilizing molten lithium for extracting impurities from other alkali metals.

Alkali metals are frequently used in the chemical industry as reactants in various processes including the synthesis of drugs and the production of organic compounds. Alkali metals in Group IA of the periodic system consist of lithium, sodium, potassium, rubidium, cesium, and francium. The purity of the particular alkali metal used in many of the chemical processes is often critical to the success of the process since the presence of metallic impurities may significantly detract from the process and/or also contaminate the end product with an undesirable concentration of metallic impurities. These metallic impurities include calcium compounds and magnesium, iron, or titanium. The purification of alkali metals for removing the above and other metallic impurities from the alkali metals include well known distillation, recrystallization and electrolysis processes. These processes have been found to be relatively expensive and, in some instances, fail to provide the alkali metal with the desired purity.

SUMMARY OF THE INVENTION

Accordingly, it is the primary aim or objective of the present invention to provide a relatively simple and economical process for effectively purifying alkali metals. Generally, the method of the present invention is an extraction process wherein impurities from a molten or liquefied alkali metal are extracted into liquefied or molten lithium by contacting the impurity-containing alkali metal in liquid form with the liquid or molten lithium. The alkali metals are then separated from the lithium which contains the impurities extracted from the alkali metals. This separation of the purified alkali metal from the impurity containing lithium may be readily achieved by utilizing the differences in the density and melting points of the lithium metal as compared to those of the other alkali metals as will be described in detail below.

Other and further objects of the present invention will be obvious upon an understanding of illustrative method about to be described or will be indicated in the appended claims and various advantages not referred to herein will occur to one skilled in the art upon employment of the invention in practice.

DETAILED DESCRIPTION OF INVENTION

In accordance with the method of the present invention, it has been found that molten alkali metals except for sodium are essentially immiscible in molten lithium metal in liquefied states. Sodium has a very limited solubility in molten lithium. On the other hand, the more common metallic impurities in alkali metals as listed above have some solubility or misciblity in molten lithium. As generally described above, the metallic impurities from the alkali metals, except for sodium, can be efficiently and effectively removed from the alkali metals by contacting a molten form of the alkali metal containing the impurities with molten lithium metal for a duration of about 10 to 15 minutes. The mixture of molten alkali metals is preferably stirred to provide a heterogeneous mixture of the molten metals. This contact between the molten alkali metals provides for the extraction of essentially all of the metallic impurities from the molten alkali metal into the molten lithium metal.

The separation of the purified alkali metal from the impurity-containing lithium metal is achievable by utilizing the differences in density and the melting points of the alkali metals as compared to lithium. Lithium has a higher melting point (180.5° C.) and a lower density than any of the other alkali metals so as to facilitate the separation of the purified alkali metal from the impurity laden lithium metal. For example, the molten mixture containing the alkali metal and the lithium metal can be cooled to a temperature below about a 180° C. so as to solidify the lithium with the impurities contained herein. The still liquid alkali metal may then be readily drained or decanted from the container holding the solidified lithium. Alternatively, the separation may be achieved by solidifying both the lithium and the alkali metal so that the differences in densities of the two metals will form two distinct layers. These layers may then be readily separated by increasing the temperature of the layered structure sufficiently to melt the alkali metal which has a melting point lower than the impurity-containing lithium metal and then decanting the molten metal.

As pointed out above the differences in density and melting point of the alkali metals in combination with their immiscibility in lithium provide for the solvent extraction of the miscible metallic impurities in the alkali metal into the lithium. This process may be achieved in a batch-type or a continuous counter-current operation.

In order to provide a more facile understanding of the present invention, an example of a typical extraction for the purification of a alkali metal is set forth below.

EXAMPLE

Equal volumes of potassium and lithium metals were placed into a thin-walled cylinder formed of iron. The lithium metal has a density of 0.53 gram/cubic centimeters and a melting point of a 180.5° C. Potassium has a density of 0.86 gram/cubic centimeters and a melting point of 64°. The loaded cylinder was then heated to a temperature of 220° C. for assuring the liquefaction of both alkali metals. A weighed quantity of calcium metal sufficient to provide a concentration of 1000 ppm in the lithium-potassium melt was then added to the melt and dissolved therein. The resulting mixture was rapidly stirred to provide the mixture with uniformly dispersed components. The mixture was then cooled under ambient conditions to room temperature to solidify the potassium and lithium. The thin-walled cylinder was then stripped by peeling from the solidified materials in the cylinder. A visual examination indicated that the lithium and potassium metals had separated into two distinctive layers. Each of these layers was then chemically analyzed with the results of this analysis being listed in the table below.

TABLE

| | Concentration of Impurities in ppm | | | |
|---|---|---|---|---|
| | Calcium | Sodium | Magnesium | Iron |
| Lithium Layer | 1930 | 90 | 66 | 150 |
| Potassium Layer | <30 | 50 | <30 | 5 |
| Distribution Coefficient | >65 | 1.8 | <30 | 30 |

As shown in the above table, essentially all of the impurities in the melt including a significant percentage of sodium, magnesium and iron which were present in the melt as a result of impurities within the potassium metal and in the container were extracted from the melt into the lithium metal. As also shown in the table, the distribution coefficient is very significant in that it shows the relation of impurities within the lithium metal is significantly greater than that of the potassium so as to adequately demonstrate the purification value of the extraction process of the present invention.

I claim:

1. A method for removing impurities from alkali metals except for sodium and lithium, comprising the steps of contacting molten lithium with a molten alkali metal containing impurities miscible in molten lithium metal for extracting essentially all of said impurities into the molten lithium metal, and thereafter separating the alkali metal from the lithium metal containing the extracted impurities.

2. The method for removing impurities from alkali metals as claimed in claim 1, wherein the impurities are metallic impurities.

3. The method for removing impurities from alkali metals as claimed in claim 1, wherein the step of contacting the molten lithium with the alkali metal containing impurities is provided by confining these alkali metals in a container and heating the contents to a temperature greater than the melting temperature of lithium metal, and including an additional step of stirring the resulting molten contents to provide a heterogeneous mixture thereof.

4. The method for removing impurities from alkali metals as claimed in claim 1, wherein the step of separating the alkali metal from the lithium metal is provided by cooling the molten alkali metals to a temperature below the melting point of lithium metal and above the melting point of the alkali metal contacted by the molten lithium, and thereafter separating the molten alkali metal from the solidified lithium metal.

* * * * *